United States Patent [19]

Smith, Jr. et al.

[11] 3,940,245

[45] Feb. 24, 1976

[54] CONVECTION SHIELD FOR ISOSTATIC BONDING APPARATUS

[75] Inventors: Charles W. Smith, Jr., Fairview; Franz Zimmerman, Erie, both of Pa.

[73] Assignee: Autoclave Engineers, Inc., Erie, Pa.

[22] Filed: Dec. 18, 1974

[21] Appl. No.: 533,828

[52] U.S. Cl. ..... 432/249; 432/242; 432/247; 432/253; 13/31

[51] Int. Cl.[2] ..... F27D 23/00

[58] Field of Search ..... 432/42, 65, 194, 225, 226, 432/245, 253, 254, 247–249, 242; 13/31, 20, 35

[56] References Cited

UNITED STATES PATENTS

| | | | |
|---|---|---|---|
| 981,109 | 1/1911 | Rappold | 432/242 |
| 2,002,241 | 5/1935 | Forde | 432/247 |
| 2,834,590 | 5/1958 | Pugh | 432/249 |
| 3,257,492 | 6/1966 | Western | 13/31 |
| 3,285,593 | 11/1966 | Tavernelli et al. | 432/247 |
| 3,295,844 | 1/1967 | Neeley et al. | 432/253 |
| 3,327,041 | 6/1967 | Clune et al. | 432/247 |
| 3,571,478 | 3/1971 | Teagan | 13/31 |
| 3,598,378 | 8/1971 | Lundstrom | 432/249 |
| 3,752,456 | 8/1973 | Larker | 13/31 |

*Primary Examiner*—John J. Camby
*Assistant Examiner*—Henry C. Yuen
*Attorney, Agent, or Firm*—Ralph Hammar

[57] ABSTRACT

A gas pressure bonding furnace having a convection shield with (1) monolithic tubular refractory insulation having its upper end surrounding the work receiving hot zone of the furnace and its lower end depending to a cool zone, (2) an impervious tubular metal shell surrounding the tubular insulation and holding it under compression by differential thermal expansion, (3) a cover closing the top of the shell by a gas tight gasket seal and (4) a piston actuated by the gas working pressure to hold the cover closed. In a preferred form, the insulation is cast in the shell and the composition is an alumina cement with embedded alumina balloons.

10 Claims, 3 Drawing Figures

CONVECTION SHIELD FOR ISOSTATIC BONDING APPARATUS

The operation of high temperature furnaces for gas pressure diffusior bonding and isostatic pressing is improved by a convection shield which prevents mass flow of the gas to the pressure vessel and simplifies the loading and unloading of the work. The furnace insulation is a refractory cement held under compression by differential thermal expansion of a metal shell spaced inward from the pressure vessel. The lower end of the shell depends to a cold zone and is open to permit pressure equalization. The upper end of the shell surrounds the hot zone of the furnace and is closed gas tight by a cover having a gasket seal and an actuator using the gas pressure so increase in working pressure cannot cause leakage.

In drawing

Figure 1:
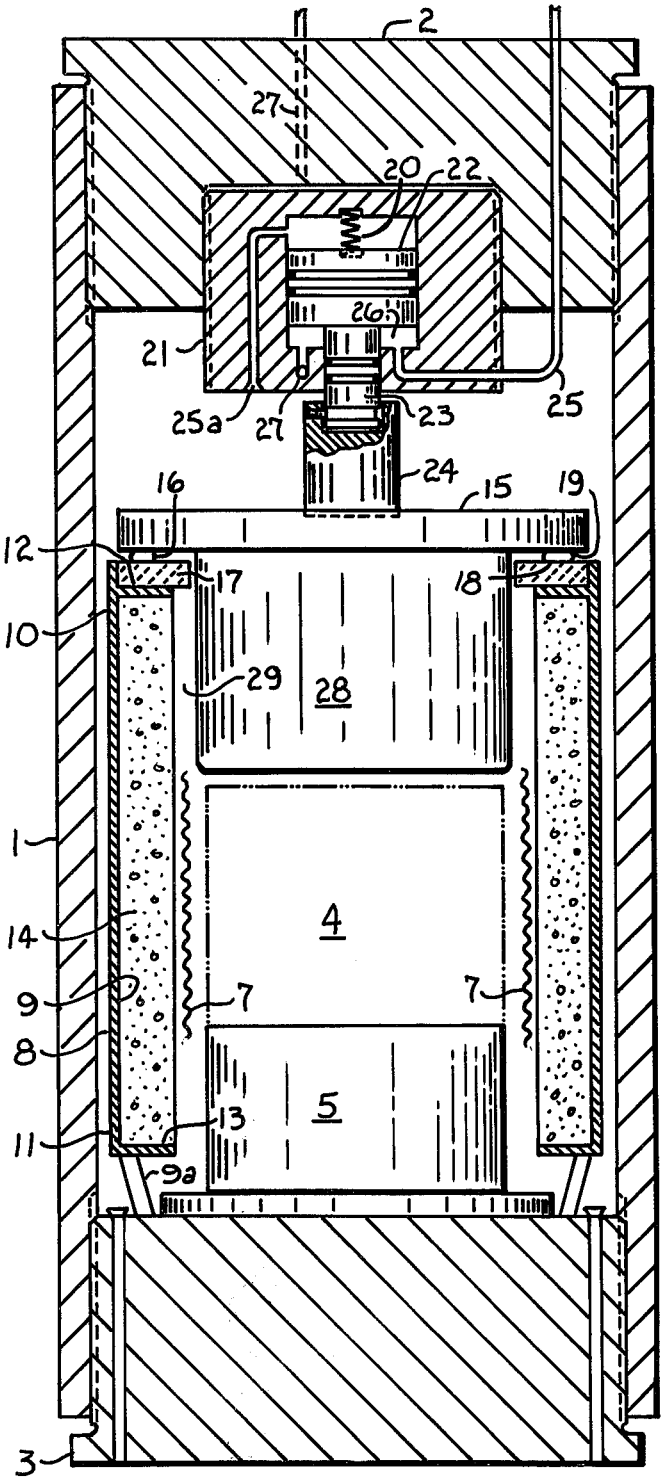
Figure 2:
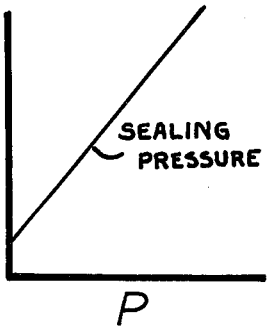
Figure 3:
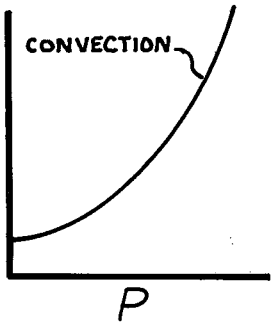

FIG. 1 is an elevation partly in section through a diffusion bonding furnace and FIGS. 2 and 3 are diagrams.

Hot isostatic pressing and diffusion bonding are carried out in a pressure vessel having upright tubular side walls 1 (usually water cooled) and top and bottom closures 2, 3. The work 4 is carried on a pedestal 5 extending upward from a suitable support (not shown) on the bottom closure. Electric heating elements 7 surround the work and create a hot zone required for heating the work. Insulation (not shown) in and around pedestal 5 results a cool zone at the lower end of the pedestal. The foregoing is of common construction and may differ substantially from the structure illustrated.

To prevent convection between the hot zone of the furnace and the walls 1 of the pressure vessel, a convection shield 8 is provided which surrounds the top and sides of the furnace and extends to the cool zone below the furnace. This shield is impermeable to gas at its top and sides and is open at the bottom for pressure equalization. Convection currents due to thermal gradients between the furnace and the cooled walls of the pressure vessel are positively prevented.

The convection shield has a tubular metal shell 9 spaced inward from the side walls 1 of the pressure vessel with its upper end extending substantially above the hot zone of the furnace and with its lower end 11 depending into the cool zone adjacent the bottom closure 3 and supported on the closure by brackets 9a. The shell has flanges 12, 13 at its upper and lower ends defining a tubular space into which is cast refractory concrete or cement insulation 14. The refractory cement may be any of the commercially available cements which can stand the operating temperature, which will block mass flow of the gas through the cement but which are sufficiently porous to permit diffusion of the gas into the cement, and which have a coefficient of thermal expansion such that the shell holds it under compression at the operating temperatures. The compression greatly increases the life by preventing cracks on the inner surface of the refractory. The combination of a steel shell and an alumina cement has given satisfactory results for operation at temperatures of 2800° F and pressures of 15,000 lbs./sq.in.

The upper end of the convection shield is closed hermetically or gas tight by a cover 15, a gasket 16 and a sealing ring 17. The sealing ring is integral with the flange 12 and has a gasket surface 18 for the gasket. The cover has a surface 19 for the gasket. Sealing pressure is applied to the cover by a spring 20 in thrust relation between the cover and the top closure. The spring is located in a body 21 removably fixed in the top closure. One end of the spring 20 is seated in a body 21 and the other end transmits a force to cover through piston 22, piston 23, and ram 24 swivelled on the lower end of piston 23. The spring 20 exerts enough force to seal at low pressures. The piston 22 which is supplied with gas working pressure through way 25a supplies enough sealing force to prevent leakage at any higher working pressure. This is important; if there were leakage through the gasket 16, convection would be set up through the leak and gas would circulate from the work piece 4 to the cold walls 1 and the resultant turbulence in the hot zone would cause uncontrollable variations in temperatures about the work piece 4. Absence of leakage becomes more important at higher pressures since convection increases faster than pressure as shown by comparison of FIGS. 2 and 3.

To prevent overheating of the pistons 22, 23 coolant may be circulated through inlet way 25 leading to space 26 between the pistons and outlet way 27 leading from the space 26. The way 27 is similar to way 25 in configuration but is in a plane at right angles to the plane of way 25. A plug 28 of castable refractory such as alumina cement is mounted on the cover 15 to insulate the cover and reduce the quantity of gas required. A similar plug may be mounted on the ram 24. The gas remains relatively quiet in the narrow space 29 around the plug 28.

Loading the furnace requires four steps. First the work piece 4 is mounted on the pedestal 5. Second the cover 15 is mounted on the sealing ring 17 at the upper end of the convection shield 8. Third, the closure 2 which carries the ram 24 and the associated parts is mounted in the upper end of the pressure vessel. Fourth, the pressure vessel is pressurized with an inert gas such as argon, etc. and the heating elements 7 are energized. A vacuum may be drawn before pressurizing to remove air. If necessary one or more purging operations with the inert gas may be carried out before final pressurizing.

Unloading requires the same steps in reverse order. First depressurizing, second removing the top closure 2, third removing the cover 15 and fourth removing the finished work piece. Both the loading and unloading operations are fast enough that the furnace does not have time to cool down between cycles. During the working cycle turbulence of the hot pressurized gas about the work piece 4 is prevented by the convection shield 8. Due to the absence of turbulence, the temperature of the gas about the work piece is uniform from top to bottom. The hermetic seal provided by the gasket 16 prevents mass flow of gas in the narrow space 29 surrounding the plug 28 on the cover 15. The gas diffuses into the porous refractory cement. This diffusion takes place without turbulence and without building up pressure differentials within the refractory cement which could cause breakage of the cement on depressurizing. By making the furnace insulation an integral part of the convection shield insulation remains in place at all times during the operation and need only be removed for replacement or repair. By casting or plastering the refractory cement directly on the inner surface of the shell 9, the space required for the furnace insulation is reduced so that a larger part of the space may be used for the furnace. The removal of cover 15 provides easy access for loading and unloading. The structure for conducting gas into and out of the vessel and the electrical connections for the heating elements are well known and need no illustrations.

The thermal insulation is increased and convection decreased dispersing low porosity open cell refractory balloons in the cement 14.

Refractory balloons are hollow spheres of high density ceramic such as alumina, zirconia, etc., of diameters in the range of 1/16 inch to ⅛ inch. For example, while the alumina cement has a density of about 75%, alumina balloons have a density of 99%. One effect of the balloons is to trap gas. The trapped gas greatly decreases the thermal conductivity. For example, the conductivity of alumina cement is about 10 and the conductivity of the high density alumina shells of the balloons is about 12. The conductivity of the argon at the operating temperatures and pressures of the furnace is about 0.01. Another effect of the balloons is to block mass flow of the gas. The low porosity shells of the balloons substantially completely block the flow of gas through the balloons. The shells of the balloons are in effect impervious to the gas. The substantial flow of heat and the substantial flow of gas must accordingly be through the restricted sections of cement between the balloons. Flow of heat and gas straight through the balloons is essentially blocked. Refractory balloons are commercially available products.

The benefits of the balloons are achieved with relatively small amounts, e.g. 20% by volume balloons and 80% by volume cement. The mechanical properties of the mixture, i.e. strength, resistance to cracking, etc. are not significantly changed.

The improved resistance to heat and gas flow both increase the efficiency of the furnace by reducing the heat loss to the pressure vessel.

What is claimed is:

1. A furnace for isotatic pressing, diffusion bonding and the like comprising a pressure vessel for holding gas at high pressures, said vessel having tubular walls with a top closure and a bottom closure, means for creating a hot zone in the upper part of the vessel and a cool zone in the lower part of the vessel, a convection shield having an impervious tubular shell open at the top and bottom and spaced inward from the vessel side walls and surrounding the hot and cool zones and having its open top spaced below said top closure, and means for hermetically sealing the open top of the tubular shell comprising a cover for closing the top of the shell and piston means in thrust relation between the top closure and the cover and energized by vessel gas pressure for forcing the cover into gas tight sealing engagement with the open top of the shell.

2. A furnace for isostatic pressing, diffusion bonding and the like comprising a pressure vessel having means for holding gas at high pressure, said vessel having tubular side walls with a top closure and a bottom closure, means for creating a hot zone in the upper part of the vessel and a cool zone in the lower part of the vessel, a convection shield having an impervious tubular shell open at the top and bottom and spaced inward from the vessel side walls and surrounding the hot and cool zones and having its open top spaced below said top closure, cover means for engaging and hermitically sealing the open top of the tubular shell and a refractory cement cast on the interior of the shell for providing thermal insulation for the hot zone and for blocking mass flow of gas through the cement to the shell.

3. The furnace of claim 2 in which the means for hermetically sealing the open top of the shell comprises a cover for closing the top of the shell and piston means in thrust relation between the top closure and the cover and energized by vessel gas pressure for forcing the cover into gas tight sealing engagement with the top of the shell.

4. The furnace of claim 2 in which the shell has an inwardly extending flange at its open top against which the refractory cement is cast and on which is mounted a sealing ring for the cover means.

5. The furnace of claim 2 in which the differential thermal expansion of the shell and cement maintains the cement under compression and prevents damaging cracks in the cement.

6. The furnace of claim 2 in which the cement has dispersed therein particles of material substantially impervious to gas.

7. The furnace of claim 6 in which the particles are open cell balloons with shells of dense ceramic.

8. The furnace of claim 7 in which the balloons are of high purity alumina.

9. The furnace of claim 7 in which the balloons are a minor fraction of the volume of the cement.

10. The furnace of claim 7 in which the balloons are about 1/16 inch to ⅛ inch in diameter.

* * * * *